United States Patent [19]

Deschamps

[11] 4,184,300

[45] Jan. 22, 1980

[54] DECORATIVE BUILDING PANEL

[75] Inventor: Leo F. Deschamps, Dollard des Ormeaux, Canada

[73] Assignee: Kool-Ray Ltd., St. Leonard, Canada

[21] Appl. No.: 943,128

[22] Filed: Sep. 18, 1978

[30] Foreign Application Priority Data

Sep. 28, 1977 [CA] Canada ..... 287215

[51] Int. Cl.[2] ..... E04C 2/42; E06B 7/08

[52] U.S. Cl. ..... 52/473; 46/31; 49/63; 52/311; 52/663; 52/666; 52/669; 403/13; 403/346; 403/388

[58] Field of Search ..... 52/473, 311, 666, 663, 52/669; 46/31, 28, 29; 49/63; 403/13, 346, 388

[56] References Cited

U.S. PATENT DOCUMENTS

| | | | |
|---|---|---|---|
| 815,550 | 3/1906 | Parkinson | 52/311 |
| 2,735,224 | 2/1956 | Estey | 52/473 X |
| 3,055,467 | 9/1962 | Peek et al. | 52/473 X |
| 3,325,198 | 6/1967 | Cruse | 52/426 |
| 3,621,631 | 11/1971 | Cutler | 52/311 X |
| 3,628,298 | 12/1971 | Sickler | 52/473 |
| 3,699,709 | 10/1972 | Schmidt | 46/28 X |
| 4,034,512 | 7/1977 | Lindal | 52/582 X |
| 4,080,768 | 3/1978 | Trixl | 403/388 |
| 4,114,307 | 9/1978 | Liebeskind | 46/29 X |

*Primary Examiner*—Alfred C. Perham
*Attorney, Agent, or Firm*—Larson, Taylor and Hinds

[57] ABSTRACT

A decorative building panel is disclosed for mounting on a wall surface. Particularly, a panel in the form of an imitation shutter. The panel is more rigid than present types of simulated shutters, also the panel may be shipped to the site in kit form and easily assembled in the field. The panel has a plurality of slats arranged side by side and at least two spaced apart straps extending across the slats. Connecting means are provided at each of the intersecting positions between the straps and the slats, the connecting means being integral with each of the straps for rigidly connecting the straps to the slats, and spacer means at each of the intersecting positions for spacing the panel from the wall surface.

11 Claims, 5 Drawing Figures

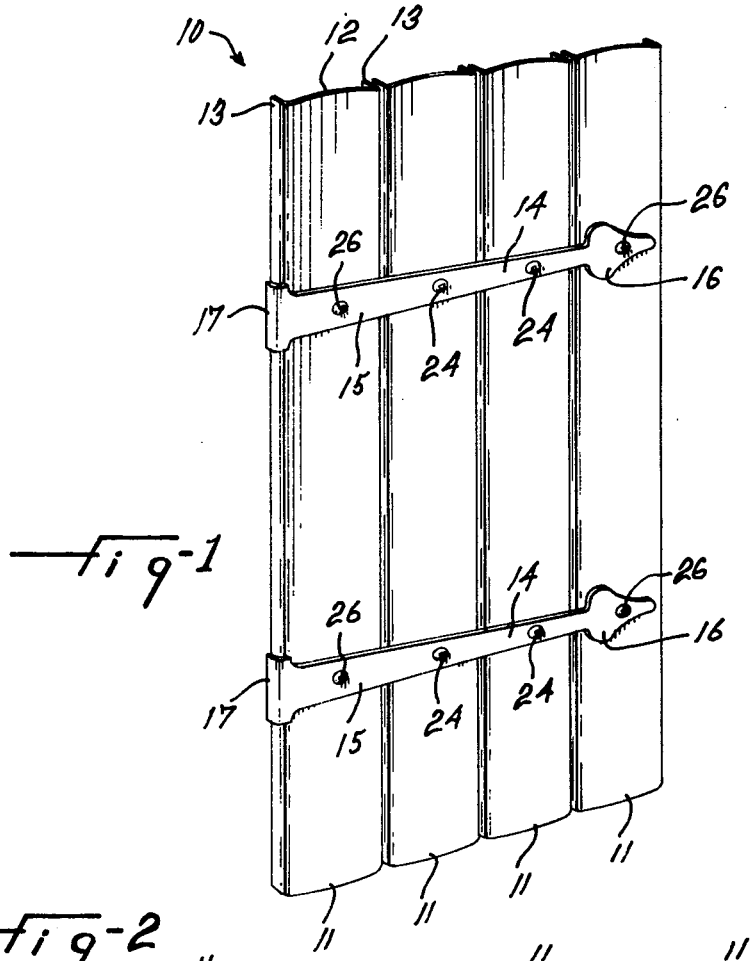
Fig-1
Fig-2
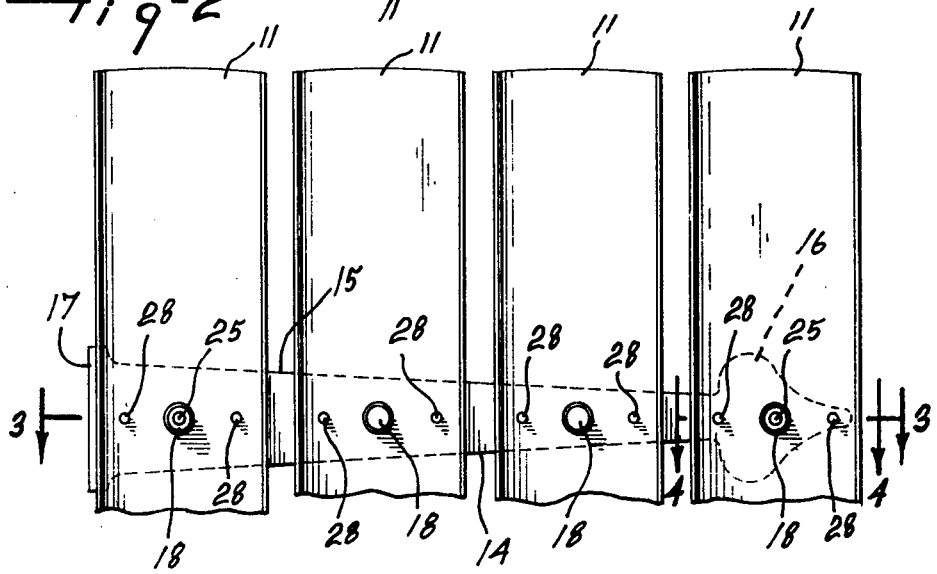

DECORATIVE BUILDING PANEL

This invention relates to a decorative building panel for mounting on a wall surface. In a preferred embodiment, the invention relates to a decorative building panel having the appearance and configuration of a shutter.

Decorative building panels are now widely used in building construction to provide different appearances to interior or exterior wall surfaces in buildings and the like. In one embodiment, decorative panels are constructed from sheets or slats to simulate window shutters, and these shutters are then fastened by means of metal straps formed to look like a hinge to the exterior wall of a house adjacent the windows to provide a pleasing architectural style. The known simulated shutters, however, generally are somewhat flimsy, or else if made of stronger materials are relatively costly because of the labour intensive manner in which the slats are connected together.

It is therefore, a purpose of the present invention to provide improved building panels, and particularly panels having the appearance of shutters, which are rigid and which can be more easily assembled than known panels thus reducing their cost. The present invention provides a panel made from slats in which the slats are simply and readily positioned relative to one another and securely fixed in place, by novel strap members to form a rigid, lightweight panel. The strap members lock the slats in place to practically eliminate any movement between adjacent slats.

The shutter panel of the present invention may be assembled without the use of tools. This facilitates selling of the panel in knocked-down, kit form if desired, which in turn simplifies packaging.

The present invention provides a decorative panel for mounting on a wall surface comprising:

a plurality of slats arranged side by side, at least two spaced apart straps extending across the slats, each of the straps having intersecting positions with each of the slats, connecting means integral with each of the straps at each of the intersecting positions for rigidly connecting the straps to the slats and spacer means integral with each of the straps at each of the intersecting positions for spacing the decorative panel from the wall surface.

In one embodiment the connecting means comprises three projecting pins integral with each of the straps, passing through three adjacent holes in each of the slats, at least one of the pins having a larger diameter than the other two pins to form the spacer means to rest against the wall surface. The larger diameter pin may be a press fit in one of the three holes, whereas the other two pins are a snug fit.

The straps are preferably molded from suitable thermoplastic material and shaped in imitation of hinges.

The invention will now be described in detail having reference to the accompanying drawings which illustrate embodiments of the invention.

FIG. 1 is a perspective view of a shutter constructed in accordance with the present invention mounted on a wall adjacent a window.

FIG. 2 is a partial plan view of the rear of the shutter.

The decorative building panel of the present invention can take various forms. One preferred form is a shutter of the type used to provide a decorative feature on houses. The shutters are usually mounted on the exterior walls of a house to flank windows such as the example shown in FIG. 1. The shutters are purely decorative and thus are fixed in place and do not swing to cover the windows.

Figure 3:
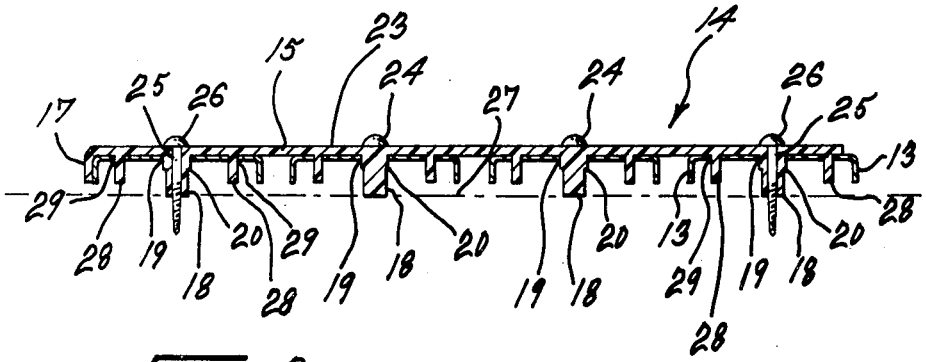
FIG. 3 is a cross-sectional view of the shutter taken along line 3—3 of FIG. 2.

As shown in FIGS. 1 to 3 the decorative shutter 10 has four narrow, rectangular slats 11 arranged parallel to one another. Four slats are shown but more or less can be used. The slats 11 are arranged side-by-side to provide the generally rectangular shutter shape. The sides of the slats 11 can abut, or be slightly spaced apart as shown. Each slat 11 is preferably made from a narrow, rectangular sheet of material which is formed in a shallow U-shape or channel shaped configuration when viewed from either end. The slat has a main front wall 12, and short side walls 13 forming the side edges of the slat. The side walls 13 provide stiffness to the slat. The slats 11 preferably are made from metal, such as aluminum, but could also be extruded or molded from suitable thermoplastic material.

Straps 14 are provided for joining the slats together. Two, or more, spaced-apart straps 14 are provided for each decorative panel or shutter assembly, each strap extending across all the slats 11 and preferably, transversely across the slats. Each strap 14 is shaped in imitation of a hinge and has a slightly tapered main body 15 with a decorative feature 16 on the end of the so-called hinge, and a short projection 17 extending perpendicularly to the main body 15 at the opposite end of the so-called hinge. Each strap 14 is positioned across the slats 11, with main body 15 lying against their front walls 12, and projection 17 against the outer sidewall 13 of the outside slat 11.

Each strap 14 has intersecting positions with each slat 11 and connecting means are provided at each intersecting position between the strap 14 and the slat 11. The connecting means comprise a central pin member 18. Each pin member 18 is cylindrical in shape although it could also be rectangular or of other shape. Each pin 18 on each strap 14 passes through a hole 19 in each slat 11, the pins 18 serving to locate the slats in slightly spaced-apart, side-by-side relation to each other.

Figure 4:
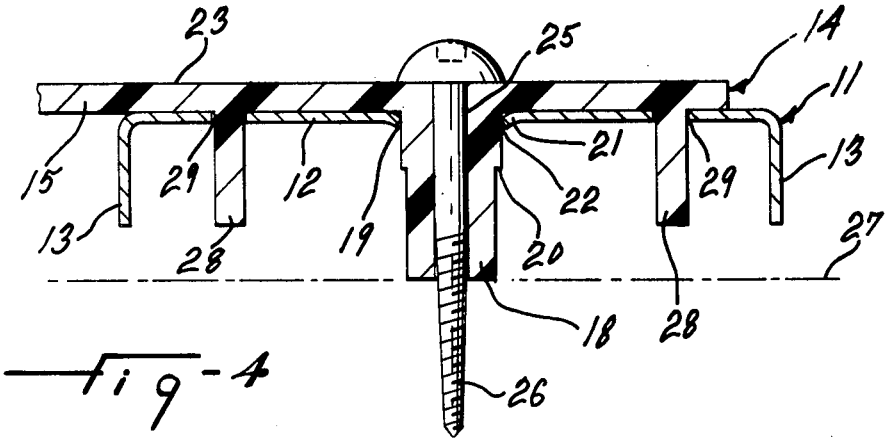
FIG. 4 is a detail cross-sectional view showing how the hinge strap is fastened to a shutter slat taken along line 4—4 of FIG. 2

In one embodiment, each pin 18 has a shoulder 20 part way along its length, and the bottom portion of the pin 18 below the shoulder 20 is a loose fit into the hole 19. The top portion of the pin 18 above the shoulder 20 is a press fit into the hole 19, and when the pin 18 is pushed fully into the hole 19, the circular area 21 of the slat 14 surrounding the hole 19 dimples inwards. The circular area 21 slopes slightly inwardly as a result of the dimpling and causes edge 22 of the hole 19 to bite or grip into the top portion of the pin 18 inserted in the hole 19 to firmly hold the strap 14 to the slat 11. This embodiment is shown in detail in FIG. 4.

The straps are preferably molded from suitable thermoplastic material with the pins 18 being integrally molded with main strap body 15. The outer surface 23 of each strap 14 is provided with a rounded protrusion 24 above the two centre pins 18 on inside slats 11, integrally molded with main body 15. Protrusions 24 simulate the heads of screws used to attach real hinges to shutter slats. No protrusions are provided above the outside pins 18 used on outside slats 11. Instead, holes 25 are formed through the main body 15 of the strap 14 and pins 18. Screws 26 pass through holes 25 and fasten the shutter to a wall 27.

Each pin 18 is longer than the depth of the side walls 13 of the slats 11. The length of the pin 18 represents the spacing means to position the shutter 10 from the wall 27. In mounting the shutter 10 on wall 27, the ends of the pins 18 abut against the wall 27 locating the slats 11 in a position spaced slightly from the wall 27. Additional locating pins 28 are provided on each strap 14 to more rigidly hold the slats 11 in position. Two additional locating pins 28 one on each side of the locating pin 18 are provided at each intersecting position. The additional locating pins 28 are smaller in diameter than locating pin 18 and extend only for the depth of the side walls 13 of the slat 11. They do not act as spacers and touch the wall 27. The additional pins 28 are integrally molded with the body 15 of the strap 14 and pass snugly through holes 29 in slats 11. The additional pins 28 together with pin 18 are in line and prevent slats 11 from rotating about pins 18 and retain the slats 11 in the shape of a shutter 10.

Figure 5:
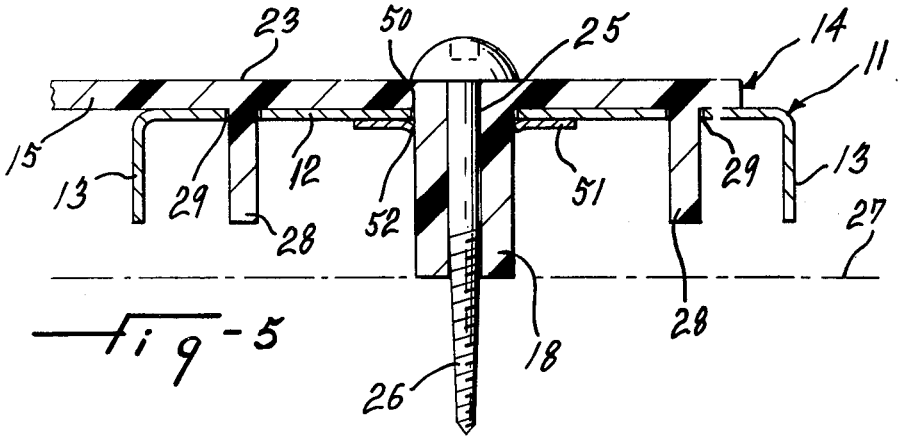
FIG. 5 is a detail cross-sectional view, similar to FIG. 4 showing another manner of fastening the hinge strap to the shutter slat.

FIG. 5 shows another embodiment of a connecting means between the strap 14 and the slat 11 at each intersecting portion. In this embodiment the holes 50 in slats 11 are made slightly larger than the pins 18 on strap 14 so that the pins 18 fit easily into the holes 50. No shoulder is required on the pins in this configuration. A locking ring 51 or spring clip is then pressed on each pin 18. The ring 51 is of the type having a gripping edge 52 which makes it difficult to take the ring 51 off the pin 18 but relatively easy to put the ring 51 on the pin 18. Such locking rings are well known. The ring 51 is placed on the pin 18, and moved down to securely lock the main wall 12 of the slat 11 between the main body 15 of the strap 14 and the ring 51.

The shutter 10 can be sold in a disassembled condition. All the slats 11 and straps 14 would be pre-finished and a purchaser would merely assemble the slats and imitation hinge straps together to form the shutter which would then be fastened on a wall with four screws 26 passed through holes 25.

Decorative wall and/or ceiling panels other than shutters, could be constructed in a similar manner using slats, and cross-straps with integral fastening pins to join the slats together. The cross-straps obviously need not be shaped to imitate hinges when making panels other than shutters.

The embodiments of the invention in which an exclusive property or privilege is claimed are defined as follows:

1. A decorative panel for mounting on a wall surface comprising, a plurality of slats arranged side-by-side, at least two spaced apart straps extending across the slats, each of the straps having intersecting positions with each of the slats, connecting means integral with each of the straps at each of the intersecting positions for rigidly connecting the straps to the slats, and spacer means integral with each of the straps at each of the intersecting positions for spacing the decorative panel from the wall surface.

2. The decorative panel according to claim 1 wherein the connecting means comprises at least one projecting pin integral with each of the straps, passing through a hole in each of the slats.

3. The decorative panel according to claim 2 wherein the pin is a press fit into the hole.

4. The decorative panel according to claim 2 including a press fit washer fitting over the pin to hold the pin in the hole.

5. The decorative panel according to claim 1 wherein the connecting means comprises three projecting pins integral with each of the straps, passing through three adjacent holes in each of the slats, at least one of the pins having a larger diameter than the other two pins and extending further than the other two pins to form the spacer means to rest against the wall surface.

6. The decorative panel according to claim 5 wherein each slat comprises a front wall and short side walls in a channel shaped configuration formed from sheet metal, and wherein the larger diameter pin extends further than the depth of the short side walls.

7. The decorative panel according to claim 5 wherein the three projecting pins are in line and wherein the centre pin has a larger diameter than the two outside pins.

8. The decorative panel according to claim 5 in the form of an imitation shutter wherein each strap is molded from suitable thermoplastic material and is shaped in approximate imitation of a strap hinge.

9. The decorative panel according to claim 5 wherein the larger diameter pin is a press fit in one of the three holes and wherein the other two pins are a snug fit in the other two holes.

10. The decorative panel according to claim 5 wherein the pins are a snug fit in the three adjacent holes, and including a press fit washer fitting over the larger diameter pin to hold the larger diameter pin in its hole.

11. The decorative panel according to claim 5 wherein two straps in the form of a hinge extend perpendicularly across four slats arranged parallel side by side evenly spaced apart, inlcuding central holes in the largest diameter pins at the intersecting portions of the two outside slats adapted to hold mounting means for mounting the decorative panel to the wall surface.

* * * * *